US012611579B2

(12) United States Patent
Zhou

(10) Patent No.: US 12,611,579 B2
(45) Date of Patent: Apr. 28, 2026

(54) BADMINTON NET RACK

(71) Applicant: Zugen Zhou, Ji'an (JP)

(72) Inventor: Zugen Zhou, Ji'an (JP)

( * ) Notice: Subject to any disclaimer, the term of this patent is extended or adjusted under 35 U.S.C. 154(b) by 663 days.

(21) Appl. No.: 18/097,588

(22) Filed: Jan. 17, 2023

(65) Prior Publication Data

US 2023/0166168 A1 Jun. 1, 2023

Related U.S. Application Data

(63) Continuation-in-part of application No. 16/849,074, filed on Apr. 15, 2020, now abandoned.

(51) Int. Cl.

| | |
|---|---|
| ***A63B 61/00*** | (2006.01) |
| ***A63B 60/56*** | (2015.01) |
| ***A63B 71/00*** | (2006.01) |
| ***A63B 71/02*** | (2006.01) |
| ***A63B 102/04*** | (2015.01) |

(52) U.S. Cl.

CPC ..... *A63B 61/003* (2013.01); *A63B 60/56* (2015.10); *A63B 71/0045* (2013.01); *A63B 71/023* (2013.01); *A63B 2102/04* (2015.10); *A63B 2210/50* (2013.01); *A63B 2225/093* (2013.01)

(58) Field of Classification Search

CPC ..... A63B 2210/50; A63B 71/0036; A63B 71/023; A63B 2225/09; A63B 71/04; A63B 2102/04; A63B 63/083; A63B 2063/001; A63B 2225/093; A63B 71/0045; A63B 60/56; A63B 61/003

See application file for complete search history.

(56) References Cited

U.S. PATENT DOCUMENTS

| | | | | |
|---|---|---|---|---|
| 5,776,007 A * | 7/1998 | Kendall | A63B 69/3676 248/176.1 |
| 6,716,123 B1 * | 4/2004 | Chen | A63B 61/00 473/492 |
| 11,596,847 B2 * | 3/2023 | Paton | B23P 15/00 |
| 12,377,330 B1 * | 8/2025 | Shi | A63B 61/003 |

(Continued)

FOREIGN PATENT DOCUMENTS

| | | |
|---|---|---|
| CN | 203389300 U * | 1/2014 |
| CN | 203436783 U * | 2/2014 |

(Continued)

*Primary Examiner* — John E Simms, Jr.
*Assistant Examiner* — Amir A Klayman
(74) *Attorney, Agent, or Firm* — JEEN IP LAW, LLC

(57) ABSTRACT

The disclosure provides a badminton net rack, comprising a base, has an grounding side and a mounting side opposite to each other, the base comprises two seat bodies, a support rod connecting the two seat bodies, and a connector spanning the support rod, the connector comprises a first stuck part and a second stuck part, the first stuck part is used for stuck badminton racket; two telescopic rods, can be switched between an inverted trapezoidal state and a stuck state, in the inverted trapezoidal state, the two telescopic rods are respectively connected to the two seat bodies to form an inverted trapezoidal structure for installing a ball net, in the stuck state, the two telescopic rods are respectively stuck to the two second stuck parts of the connector. The above-mentioned badminton net rack has various functions, is more portable and has better stability.

11 Claims, 17 Drawing Sheets

(56) References Cited

U.S. PATENT DOCUMENTS

| | | | | |
|---|---|---|---|---|
| 2007/0087869 | A1* | 4/2007 | Lin | A63B 61/02 473/492 |
| 2014/0135153 | A1* | 5/2014 | Wartenweiler | A63B 71/023 473/478 |
| 2015/0057109 | A1* | 2/2015 | Chen | A63B 69/0002 473/416 |
| 2015/0165289 | A1* | 6/2015 | Chen | A63B 61/003 473/478 |
| 2017/0232319 | A1* | 8/2017 | Nelson | A63B 69/002 473/446 |
| 2018/0015343 | A1* | 1/2018 | Orenstein | A63B 61/003 |
| 2018/0290035 | A1* | 10/2018 | Ali | A63B 63/00 |
| 2019/0038951 | A1* | 2/2019 | Curry | F16M 11/22 |

FOREIGN PATENT DOCUMENTS

| | | | | | |
|---|---|---|---|---|---|
| CN | 203436784 | U | * | 2/2014 | |
| CN | 203915988 | | * | 11/2014 | |
| CN | 203915988 | U | * | 11/2014 | |
| CN | 103223233 | B | * | 11/2015 | |
| CN | 106267757 | A | * | 1/2017 | |
| CN | 107261445 | A | * | 10/2017 | A63B 61/02 |
| CN | 108261743 | A | * | 7/2018 | A63B 61/003 |
| CN | 109925688 | A | * | 6/2019 | |
| CN | 111957019 | A | * | 11/2020 | A63B 61/04 |

* cited by examiner

900

BADMINTON NET RACK

CROSS-REFERENCE TO RELATED APPLICATIONS

This is a continuation in part of U.S. patent application Ser. No. 16/849,074, with a filing date of Apr. 15, 2020, the entire contents of which are hereby incorporated by reference in their entireties.

TECHNICAL FIELD

The present disclosure relates to the technical filed of sporting goods, and in particular to a badminton net rack.

BACKGROUND

Badminton is a very popular sport. People often choose to play badminton on roadsides, lawns, parks or squares to avoid the problem of badminton fees and long distances. However, there are no badminton net racks in places such as roadsides, lawns, parks or squares, which cannot meet certain playing standards. Based on this problem, there are portable badminton net racks on the market. However, the existing badminton net racks either have single function, poor stability, or large size, and cannot really achieve the purpose of portability.

SUMMARY

The present disclosure provides a badminton net frame with various functions, which is more portable and has better stability.

A badminton net rack, comprising: a base, has an grounding side and a mounting side opposite to each other, the base comprises two seat bodies, a support rod connecting the two seat bodies, and a connector spanning the support rod, the connector comprises a first stuck part and a second stuck part, the opening of the first stuck part faces the grounding side, the opening of the second stuck part faces the mounting side, and the first stuck part is used for stuck badminton racket; two telescopic rods, can be switched between an inverted trapezoidal state and a stuck state, in the inverted trapezoidal state, the two telescopic rods are respectively connected to the two seat bodies to form an inverted trapezoidal structure for installing a ball net, in the stuck state, the two telescopic rods are respectively stuck to the two second stuck parts of the connector; a ball net, can be installed on the two telescopic rods in the inverted trapezoidal state; an outside of the telescopic rod is arranged with a stuck device, and an inside of the telescopic rods is arranged with several auxiliary rods, an end of the auxiliary rod is arranged with a lock rod, and the lock rod is arranged with an elastic fixed wrench.

In one embodiment, the seat body has an insertion port, and an end of the support rod is interference-fitted with the insertion port of the seat body.

In one embodiment, there are three support rods, which are two first support rods and one second support rod, and the two first support rods are closer to the grounding side than the second support rod, and are spaced arranged at equal heights, the second support rod is closer to the mounting side than the two first support rods, and is located between the two first support rods; the connector also comprises a third stuck part at end and a fourth stuck part at middle, the openings of the two third stuck parts at end are opposite, and they are respectively stuck to the two first support rod, the opening of the fourth stuck part faces the mounting side, and is stuck to the second support rod.

In one embodiment, a distance between the two seat bodies is greater than the length of the badminton racket.

In one embodiment, there are multiple connectors, and the multiple connectors are arranged at intervals along the length direction of the support rod.

In one embodiment, the connector comprises a plurality of first stuck parts, and the plurality of first stuck parts are arranged at intervals along the length direction of the connector, and the spacing distance between two adjacent first stuck parts can realize: when the badminton rackets are stuck one-to-one with the first stuck parts, the two badminton rackets on two adjacent first stuck parts can be partially stacked.

In one embodiment, the distance between two adjacent first stuck parts can realize: when the badminton racket is stuck one-to-one with the first stuck parts, the overlapping portion of the mesh portion of the two badminton rackets on the two adjacent first stuck parts is greater than two-thirds of the mesh portion.

In one embodiment, the first stuck part is used for stuck with the thin shaft part of the badminton racket, and the depth of the first stuck part is greater than the sum of the diameters of the thin shaft parts of at least two badminton rackets.

In one embodiment, the seat body comprises an accommodating space, which can accommodate at least one of the ball net or badminton or parts.

In one embodiment, the seat body comprises a rotation locking mechanism, and the telescopic rod is interference-fitted insert into the rotation locking mechanism, and the rotation locking mechanism can drive the telescopic rod to rotate, so that the telescopic rod switch between the suck state and the inverted trapezoidal state.

In one embodiment, the end of the ball net is arranged with an installation pocket, and the end of the telescopic rod away from the seat body can be inserted into the installation pocket to install the ball net.

In one embodiment, the badminton net rack further comprises a reinforce rod, the ball net comprises a net body and a lining cloth located at the end of the net body, the side of the lining cloth away from the net body can be connected to the telescopic rod, and the junction of the lining cloth and the net body is arranged with a reinforce bag, and the reinforce rod can be plugged into the reinforce bag.

The badminton net rack uses two telescopic rods to install the ball net, and the two telescopic rods can be fixed on the base by the second stuck part, so that the badminton net rack has the function of being easy to carry, and at the same time, the badminton net rack can also stuck the badminton racket by the first stuck part, the badminton net rack also has the function of accommodating the badminton racket. Therefore, the above-mentioned badminton net rack has the characteristics of various functions relative to the traditional badminton net rack. Moreover, the above-mentioned badminton net rack fixes the telescopic rod and the badminton racket on opposite sides of the base respectively. Compared with fixing the telescopic rod and the badminton racket on the same side of the base, the base in this embodiment can have a relatively small size. The width (assuming that the length of the base is fixed), so that the badminton net rack has a smaller size and is more portable. In addition, the base of the above-mentioned badminton net rack comprises two seat bodies, a support rode connecting the two seat bodies, and a connector spanning the support rode. Compared with the base including only one seat body, the base in this embodiment can has a relatively small weight (assuming that the length and width of the base are fixed), making it easier to carry. Moreover, compared with the base that only includes one seat body, the contact area between the base and the ground in this embodiment can also be relatively small, and there is no need for a large continuous flat ground. When the flatness of the ground is poor, the base can still be stabilized on the ground, thereby improving the stability of the badminton net rack.

DETAILED DESCRIPTION

The present disclosure will be described in further detail below in conjunction with the accompanying drawings and specific embodiments. Advantages and features of the present disclosure will be apparent from the following description and claims. It should be noted that all the drawings are in a very simplified form and use imprecise scales, and are only used to facilitate and clearly assist the purpose of illustrating the embodiments of the present disclosure.

Figure 1:
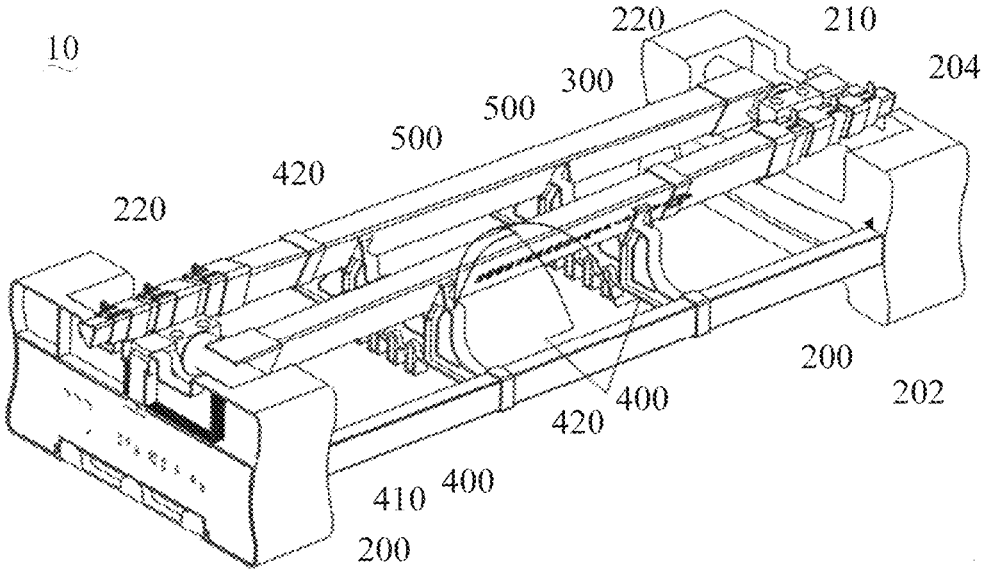
FIG. 1 is a structural schematic diagram of a badminton net rack in an embodiment of the present disclosure, wherein two telescopic rods are in a stuck state.
Figure 2:
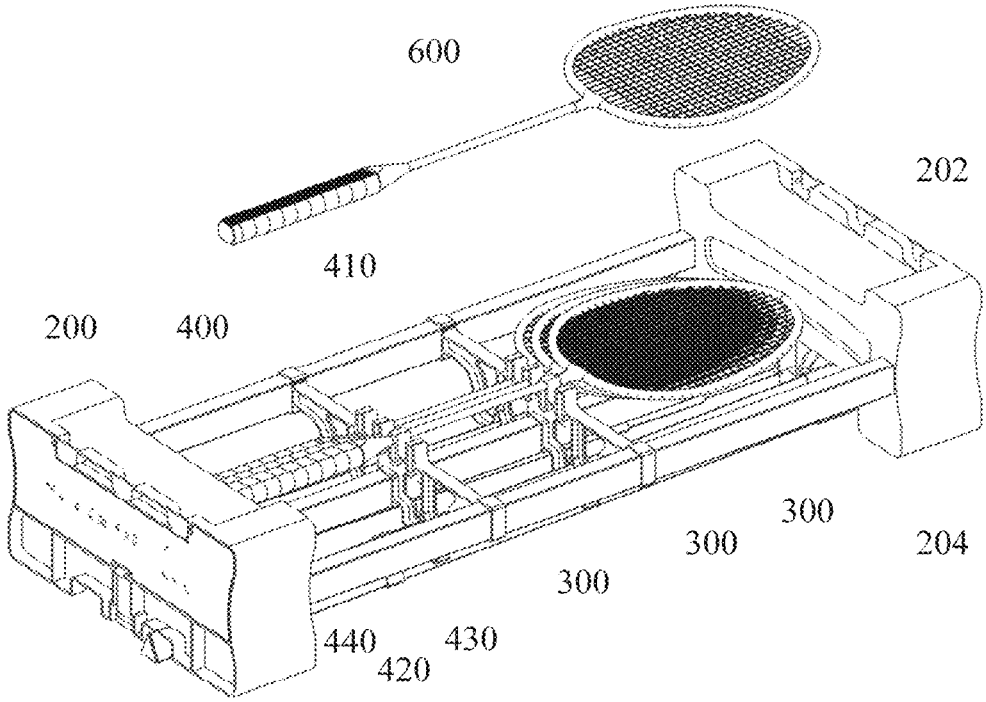
FIG. 2 is a structural schematic diagram of another viewing angle of the badminton net rack shown in FIG. 1.
Figure 3:
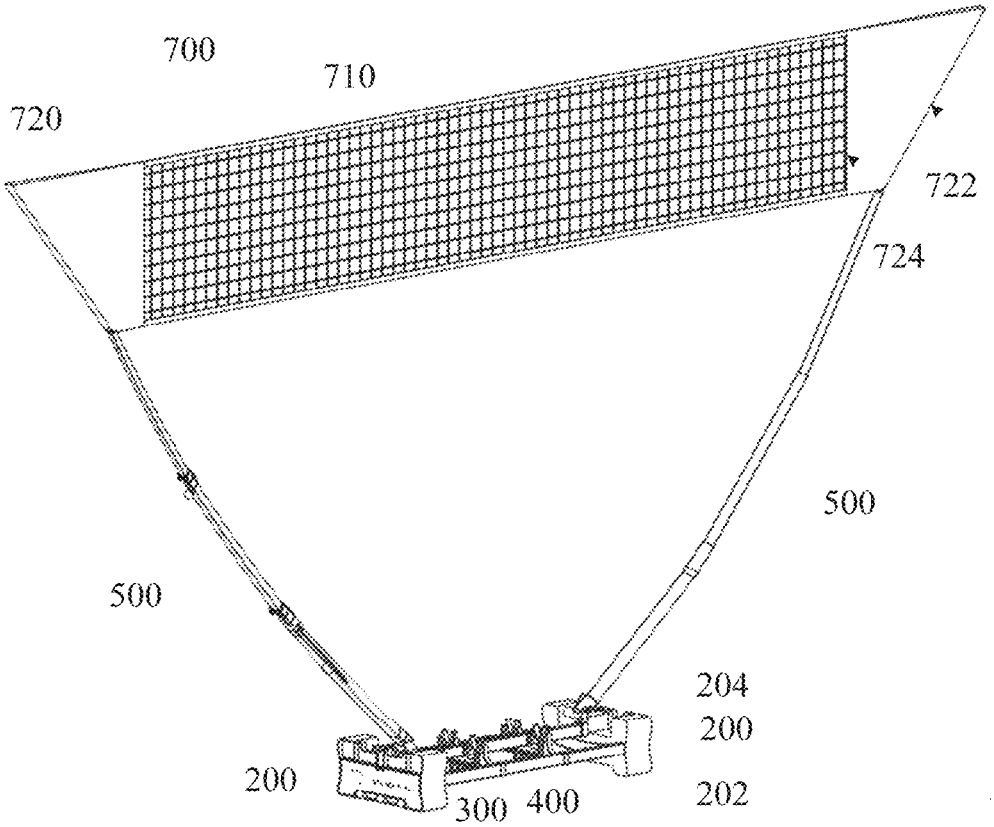
FIG. 3 is a structural schematic diagram of the badminton net rack shown in FIG. 1 in use.
Figure 4:
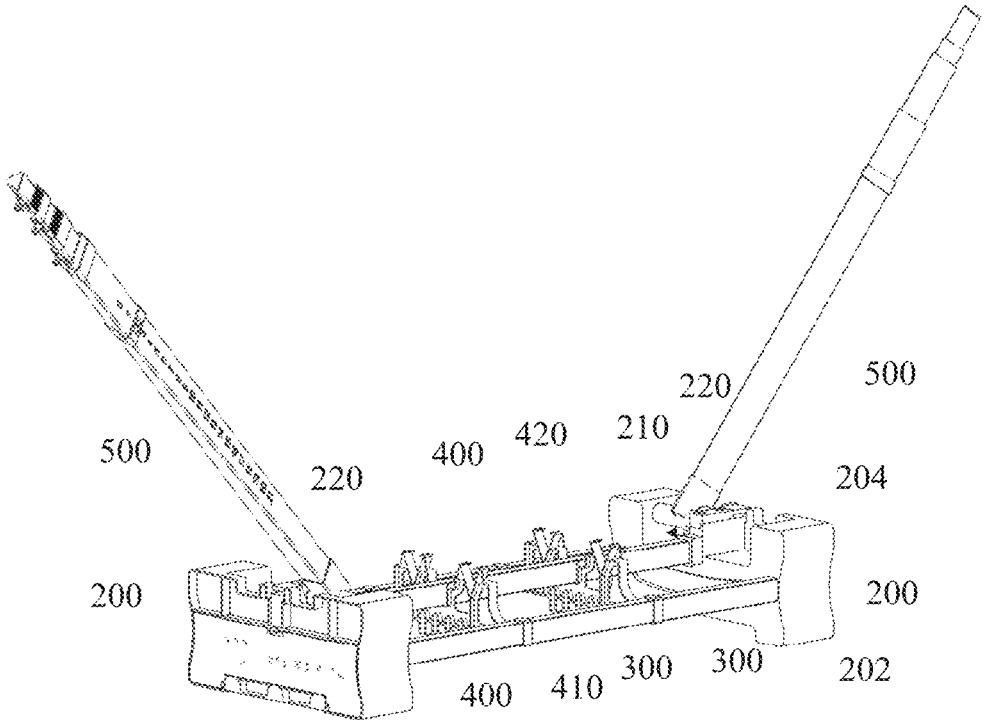
FIG. 4 is a structural schematic diagram of a badminton net rack shown in FIG. 1, wherein the two telescopic rods are in an inverted trapezoidal state.
Figure 5:
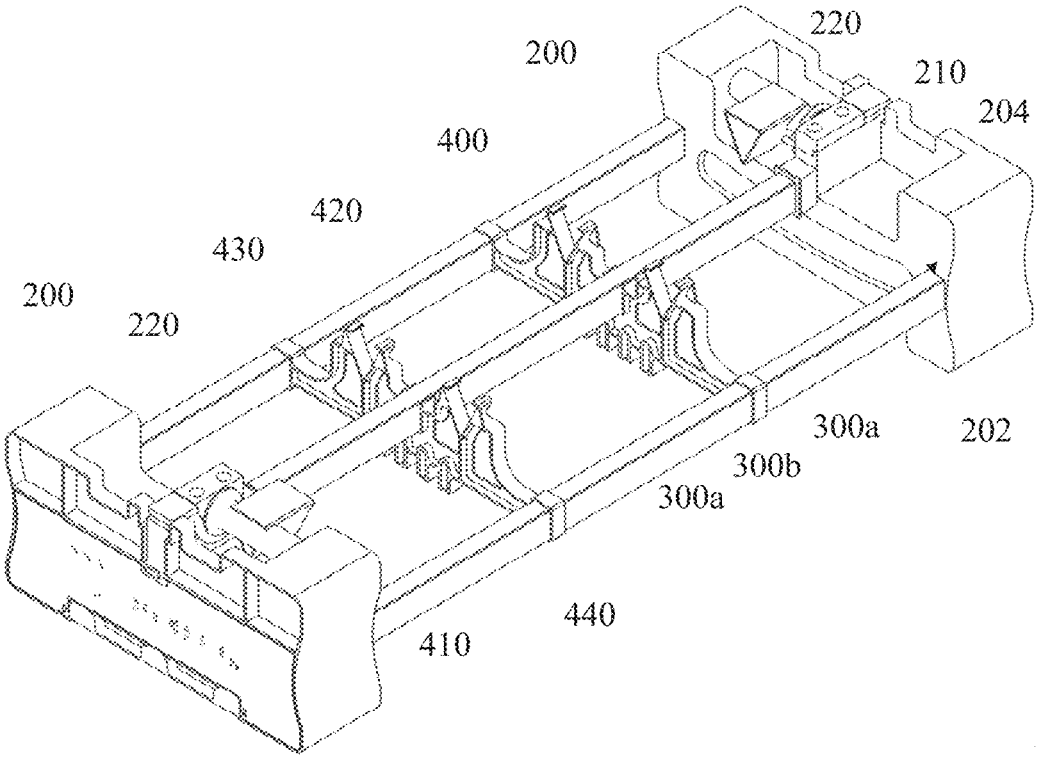
FIG. 5 is a structural schematic diagram of a base of the badminton net rack shown in FIG. 1.
Figure 6:
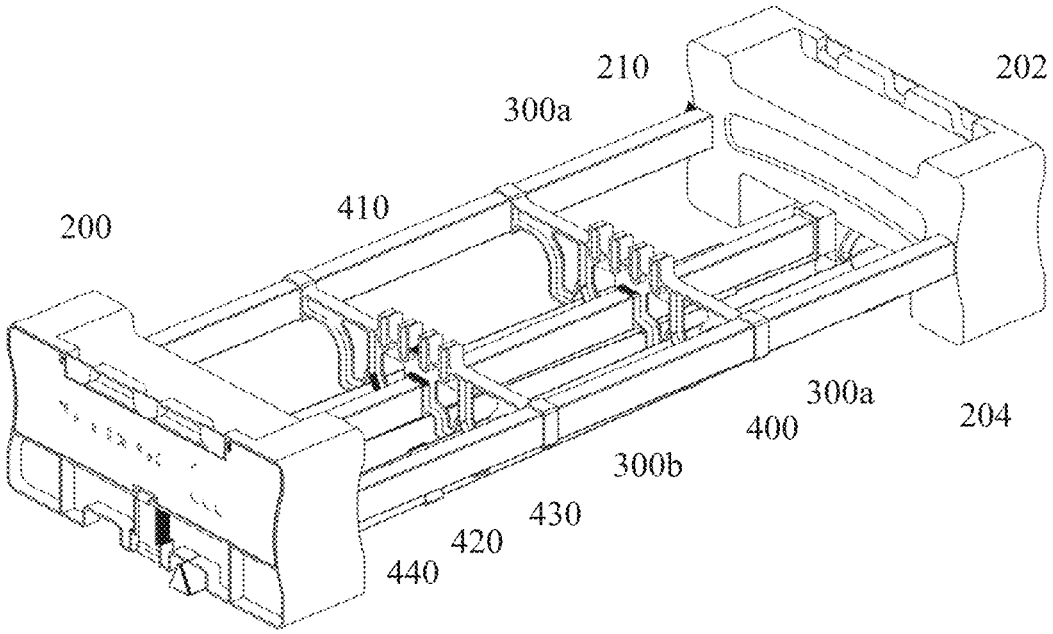
FIG. 6 is a structural schematic diagram of another viewing angle of the base of the badminton net rack shown in FIG. 1.

As shown in FIGS. 1-3, the badminton net rack 10 provided by the present disclosure comprises a base, a telescopic rod 500 and a ball net 700. The base has an grounding side 202 and a mounting side 204 opposite to each other, the base comprises two seat bodies 200, a support rod 300 connecting the two seat bodies 200, and a connector 400 spanning the support rod 300. There are two telescopic rods 500. The two telescopic rods 500 can be switched between an inverted trapezoidal state and a stuck state, in the inverted trapezoidal state, the two telescopic rods 500 are respectively connected to the two seat bodies 200 to form an inverted trapezoidal structure for installing a ball net 700, in the stuck state, the two telescopic rods 500 are respectively stuck to the base. The ball net 700 can be installed on the two telescopic rods 500 in the inverted trapezoidal state.

As shown in FIGS. 1-6, in this embodiment, the connector 400 comprises a first stuck part 410 and a second stuck part 420, the opening of the first stuck part 410 faces the grounding side 202, the opening of the second stuck part 420 faces the mounting side 204, and the first stuck part 410 is used for stuck badminton racket 600. The second stuck part 420 is used to stuck the telescopic rod 500, that is, in the stuck state, the two telescopic rods 500 are respectively stuck to the two second stuck part 420 of the connector 400.

The badminton net rack 10 uses two telescopic rods 500 to install the ball net 700, and the two telescopic rods 500 can be fixed on the base by the second stuck part 420, so that the badminton net rack 10 has the function of being easy to carry, and at the same time, the badminton net rack 10 can also stuck the badminton racket 600 by the first stuck part 410, the badminton net rack 10 also has the function of accommodating the badminton racket 600. Therefore, the above-mentioned badminton net rack 10 has the characteristics of various functions relative to the traditional badminton net rack 10. Moreover, the above-mentioned badminton net rack 10 fixes the telescopic rod 500 and the badminton racket 600 on opposite sides of the base respectively. Compared with fixing the telescopic rod 500 and the badminton racket 600 on the same side of the base, the base in this embodiment can have a relatively small size. The width (assuming that the length of the base is fixed), so that the badminton net rack 10 has a smaller size and is more portable. In addition, the base of the above-mentioned badminton net rack 10 comprises two seat bodies 200, a support rode 300 connecting the two seat bodies 200, and a connector 400 spanning the support rode 300. Compared with the base including only one seat body, the base in this embodiment can has a relatively small weight (assuming that the length and width of the base are fixed), making it easier to carry. Moreover, compared with the base that only includes one seat body, the contact area between the base and the ground in this embodiment can also be relatively small, and there is no need for a large continuous flat ground. When the flatness of the ground is poor, the base can still be stabilized on the ground, thereby improving the stability of the badminton net rack 10.

Figure 7:
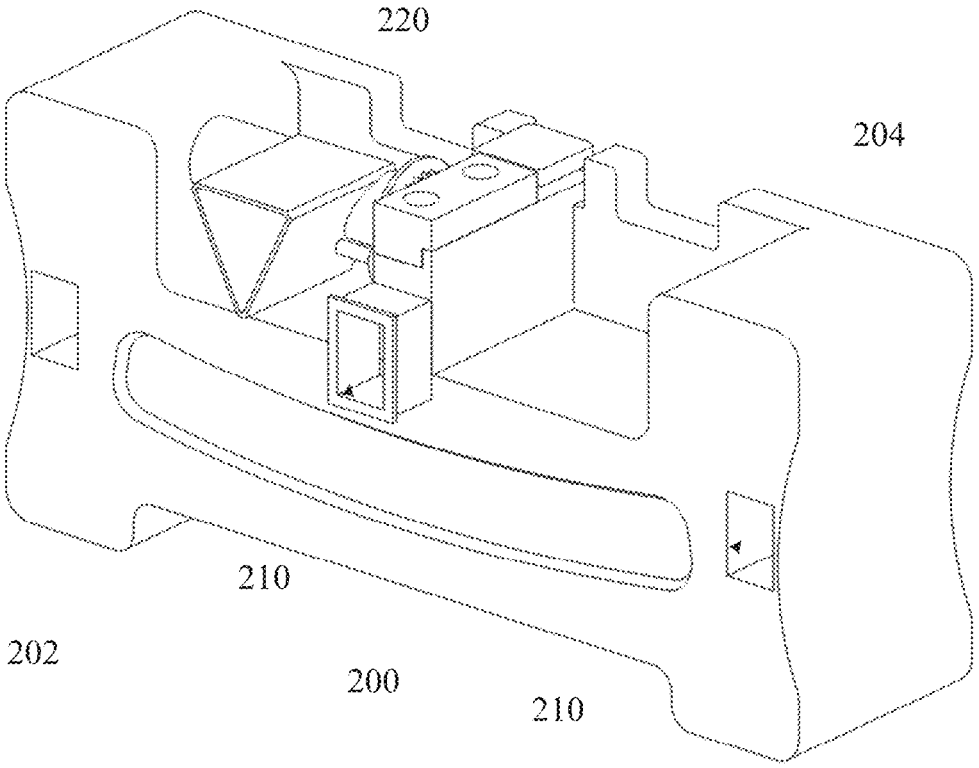
FIG. 7 is a structural schematic diagram of the seat body of the base shown in FIG. 6.
Figure 8:
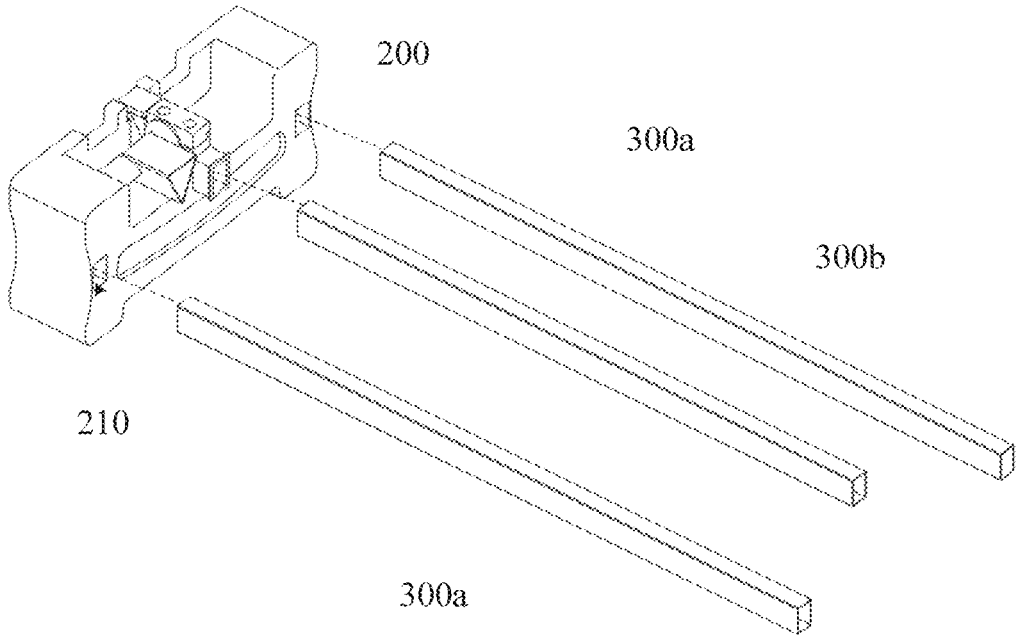
FIG. 8 is a structural schematic diagram of the base shown in FIG. 6 in the first step of the assembly process.
Figure 9:
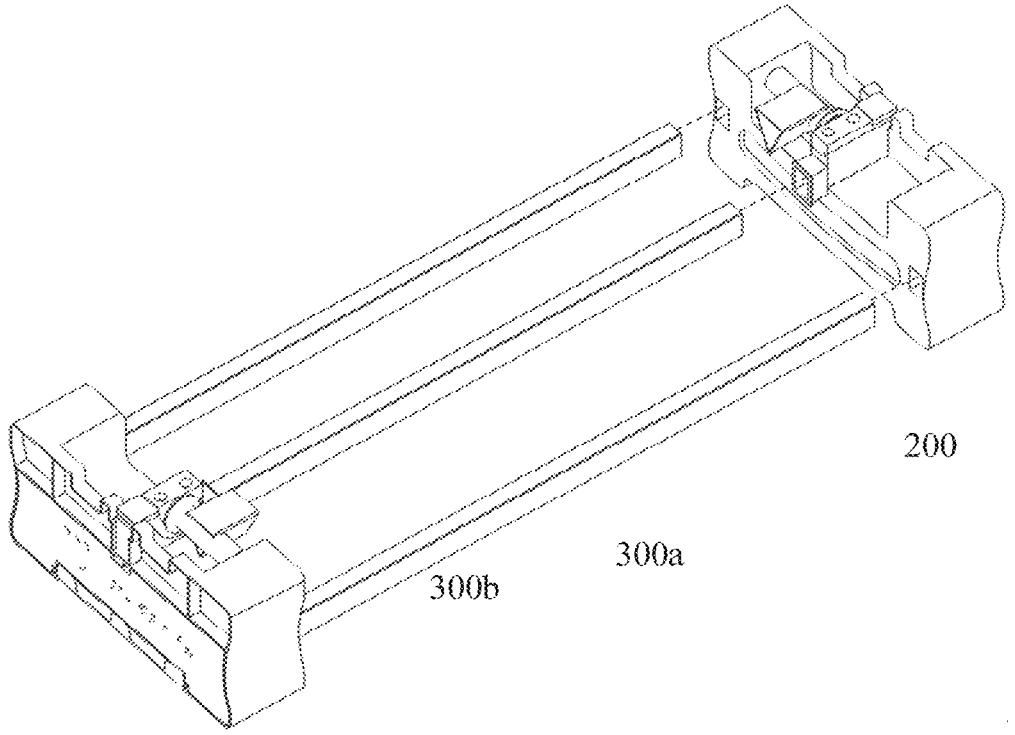
FIG. 9 is a structural schematic diagram of the base shown in FIG. 6 in the second step of the assembly process.

In this embodiment, as shown in FIGS. 7-9, the seat body 200 is detachably connected to the support rod 300. In this way, it is very convenient for transportation. During transportation, the base can be disassembled into parts for transportation. Specifically, in this embodiment, the seat body 200 has an insertion port 210, and the end of the support rod 300 is interference-fitted with the insertion port 210 of the seat body 200. In this way, it is very convenient to assemble the seat body 200 and the support rod 300. It can be understood that in other embodiments, the support rod 300 and the seat body 200 can also be fixed by welding. In other embodiments, the support rod 300 and the seat body 200 can also be detachably connected by screws or buckles.

Figure 10:
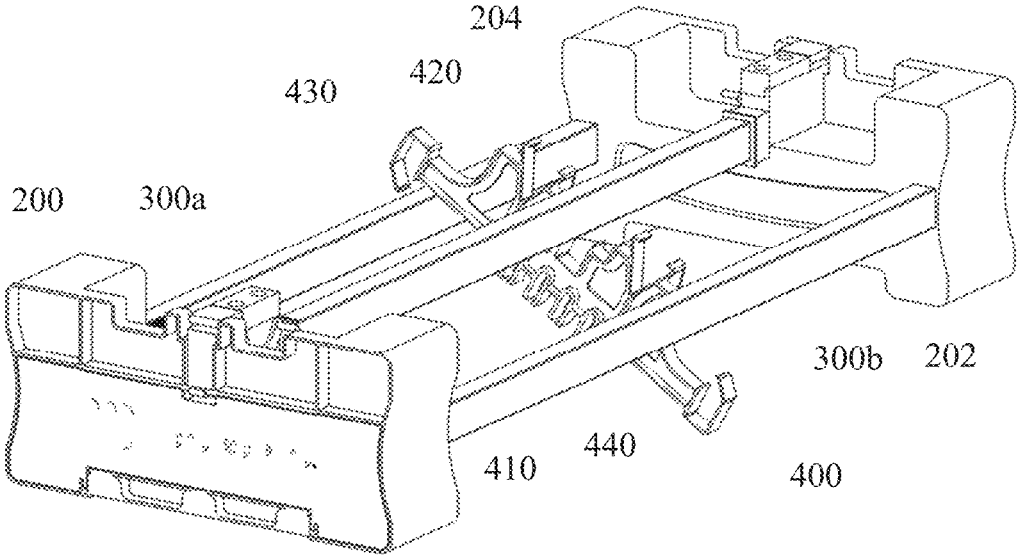
FIG. 10 is a structural schematic diagram of the base shown in FIG. 6 in the third step of the assembly process.

In this embodiment, as shown in FIGS. 9 and 10, there are three support rods 300, which are two first support rods 300*a* and one second support rod 300*b*, and the two first support rods 300*a* are closer to the grounding side than the second support rod 300*b*, and are spaced arranged at equal heights, the second support rod 300*b* is closer to the mounting side than the two first support rods 300*a*, and is located between the two first support rods 300*a*. The connector 400 also comprises a third stuck part 430 at end and a fourth stuck part 440 at middle, the openings of the two third stuck parts 430 at end are opposite, and they are respectively stuck to the two first support rod 300*a*, the opening of the fourth stuck part 440 faces the mounting side 204, and is stuck to the second support rod 300*b*. In this way, it is not only very convenient to assemble the connector 400, but also can make the base structure stable. It can be understood that in other embodiments, there may be only one or two or more than three support rods 300. The connector 400 can be welded on the support rod 300, and can also be fixed on the support rod 300 by screws, buckles and the like.

In this embodiment, a distance between the two seat bodies 200 is greater than the length of the badminton racket 600. In this way, the badminton racket 600 can be accommodated between the two seat bodies 200, so that the badminton racket 600 can be effectively protected. Specifically, in this embodiment, the distance between the two seat bodies 200 is adapted (equivalent) to the length of a standard adult badminton racket. In this way, it is more beneficial to make the badminton net rack 10 have a smaller size and be more portable.

In this embodiment, there are multiple connectors 400, and the multiple connectors 400 are arranged at intervals along the length direction of the support rod 300. In this way, the strength of the base can be increased, and it is also more conducive to securely fastening the telescopic rod 500 and the badminton racket 600. Specifically, in this embodiment, there are two connector 400.

In this embodiment, the connector 400 comprises a plurality of first stuck parts 410, and the plurality of first stuck parts 410 are arranged at intervals along the length direction of the connector 400, and the spacing distance between two adjacent first stuck parts 410 can realize: when the badminton rackets 600 are stuck one-to-one with the first stuck parts 410, the two badminton rackets 600 on two adjacent first stuck parts 410 can be partially stacked. In this way, the base in this embodiment can be made to have a relatively small width (assuming that the length of the base is fixed), so that the badminton net rack 10 can have a smaller size and be more portable. Specifically, in this embodiment, the distance between two adjacent first stuck parts 410 can realize: when the badminton racket 600 is stuck one-to-one with the first stuck parts 410, the overlapping portion of the mesh portion of the two badminton rackets 600 on the two adjacent first stuck parts 410 is greater than two-thirds of the mesh portion (It should be noted that the badminton racket 600 includes a handle part, a thin rod part and a grid part connected in sequence). In this way, the base in this embodiment can have a relatively smaller width. Moreover, a plurality of first stuck parts 410, and the badminton racket 600 and the first stuck part 410 can be fastened in a one-to-one fastening manner, thereby making it easier to fasten the badminton racket 600, and the first stuck part 410 relatively low strength requirements. It can be understood that in other embodiments, when the strength of the first stuck part 410 is relatively high, the depth of the first stuck part 410 is also relatively deep, and there may be only one first stuck part 410, and multiple badminton rackets 600 are stacked be stuck on the same first stuck part 410.

In this embodiment, the first stuck part 410 is used for stuck with the thin shaft part of the badminton racket 600, and the depth of the first stuck part 410 is greater than the sum of the diameters of the thin shaft parts of at least two badminton rackets 600. In this way, while the two badminton rackets 600 on two adjacent first stuck parts 410 can be partially laminated, the dimensions of the multiple first stuck parts 410 can be made the same, which is more convenient for making the connector 400. It can be understood that in other embodiments, the plurality of first stuck parts 410 may also have different depths. Specifically, in this embodiment, there are four first stuck parts 410 and four badminton rackets 600, and the depth of the first stuck parts 410 is greater than the sum of the diameters of the thin shafts of the four badminton rackets 600.

Figure 11:
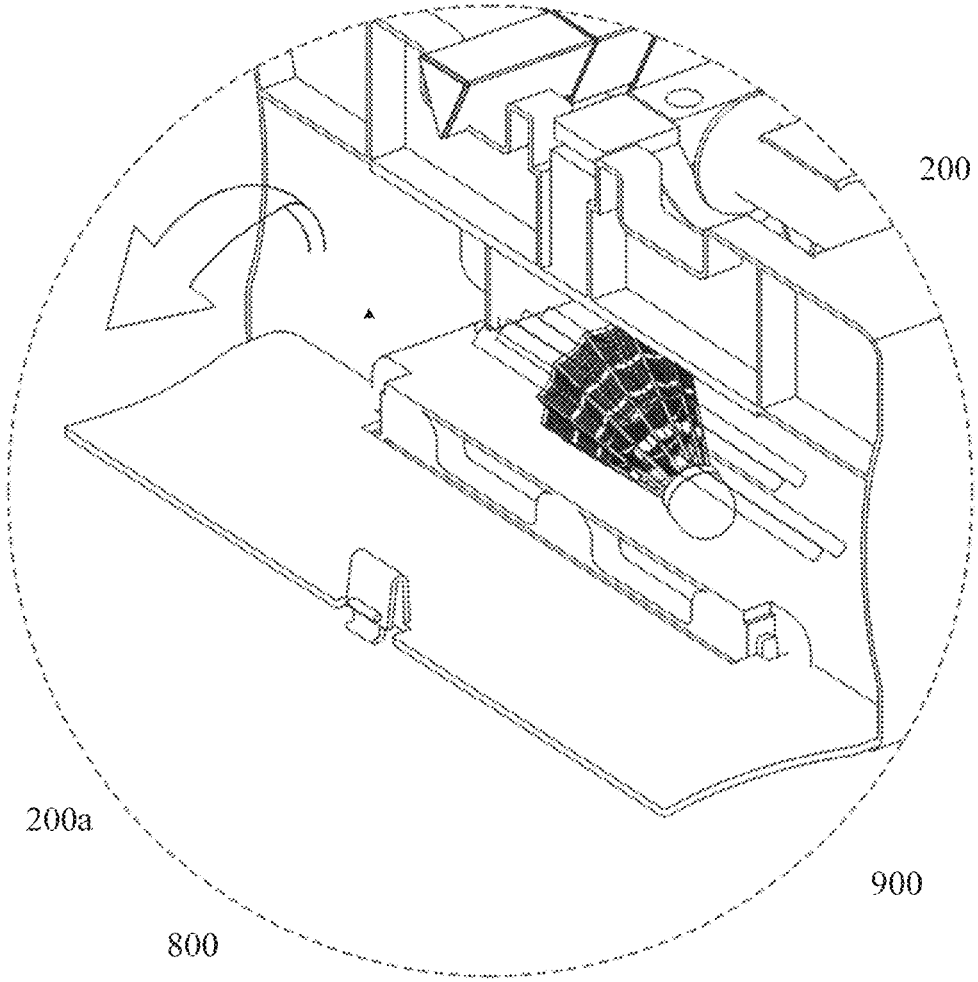
FIG. 11 is a structural schematic diagram of the internal structure of a seat body of the base shown in FIG. 6.
Figure 12:
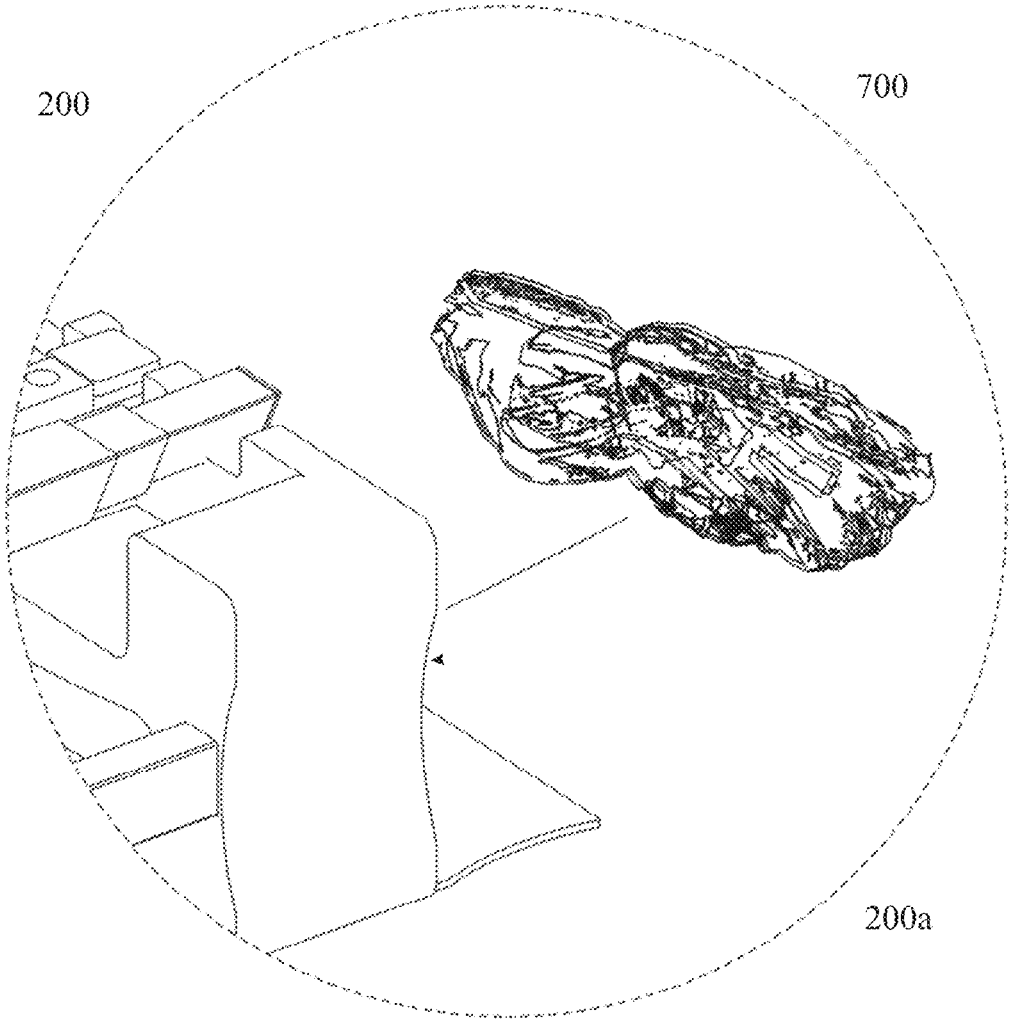
FIG. 12 is a structural schematic diagram of the internal structure of another seat body of the base shown in FIG. 6.

In this embodiment, as shown in FIGS. 11 and 12, the seat body 200 comprises an accommodating space 200*a*, which can accommodate at least one of the ball net 700 or badminton 800 or parts. In this way, the functions of the badminton net rack 10 can be enriched. Specifically, in this embodiment, the accommodating space 200*a* of one seat body 200 is used to accommodate the ball net 700, and the accommodating space 200*a* of the other seat body 200 is used to accommodate the badminton 800.

Figure 13:
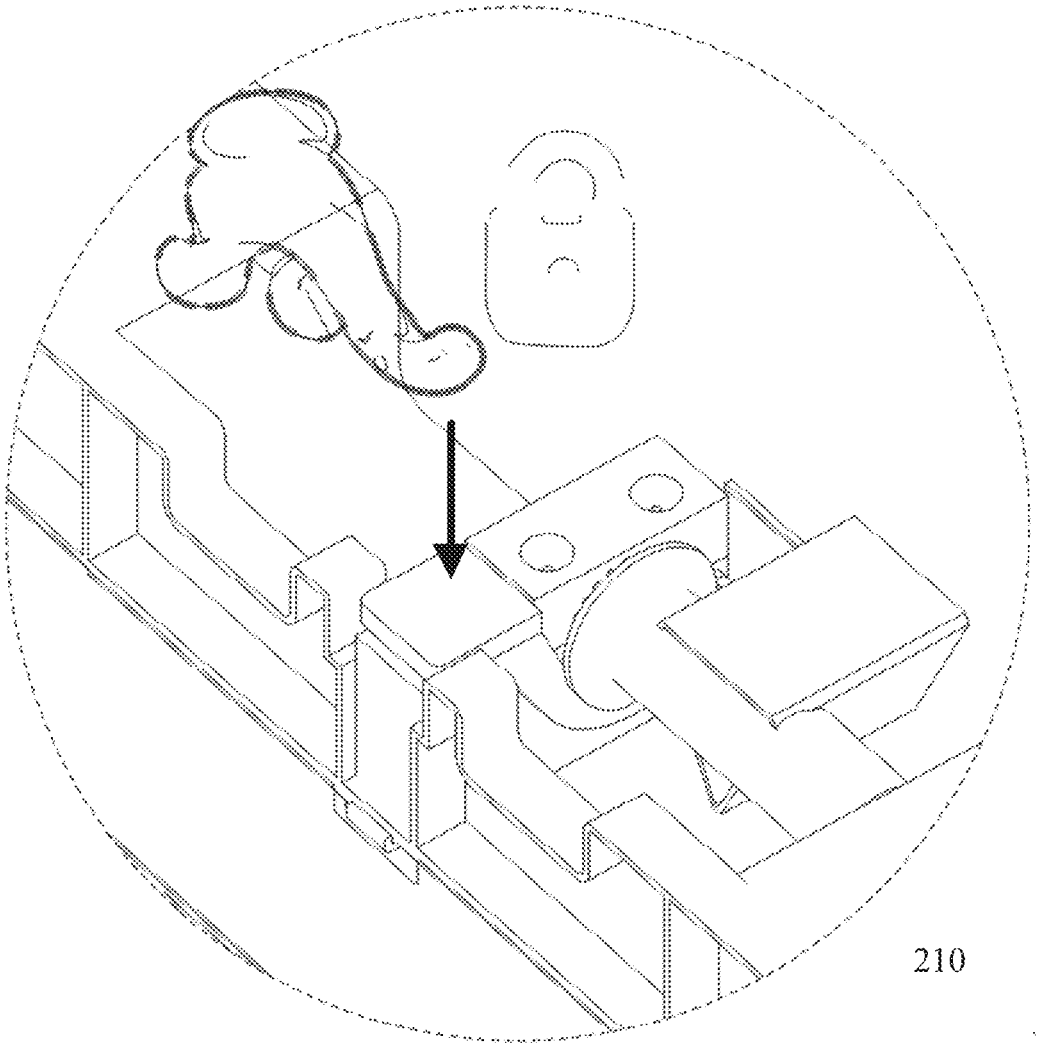
FIG. 13 is a partially enlarged view of a seat body of the base shown in FIG. 6, wherein the rotation locking mechanism can be connected with the telescopic rod in a stuck state.
Figure 14:
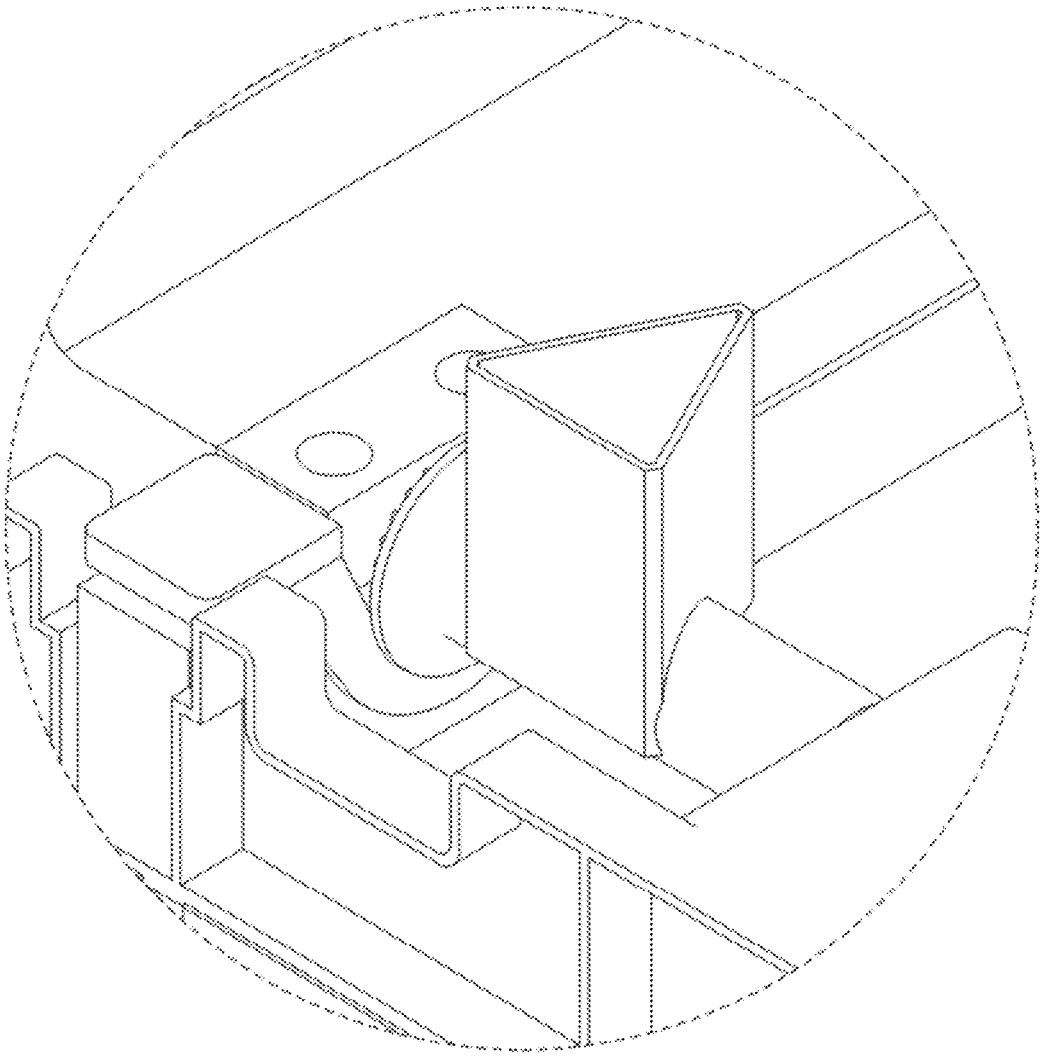
FIG. 14 is a partially enlarged view of a seat body of the base shown in FIG. 6, wherein the rotation locking mechanism has been rotated by 90°.

In this embodiment, as shown in FIG. 13 and FIG. 14, the telescopic rod 500 is rotatably connected to the seat body 200, so that the telescopic rod 500 can switch between a stuck state and an inverted trapezoidal state. In this way, it is very convenient for the telescopic rod 500 to switch between the stuck state and the inverted trapezoidal state. It can be understood that, in other embodiments, when the telescopic rod 500 in the inverted trapezoidal state can be detachably connected with the seat body 200, when the badminton net rack 10 needs to be used, the telescopic rod 500 in the clamped state can be firstly removed from the base, and then assemble it on the seat body 200 to form an inverted trapezoidal structure, and stretch the telescopic rod 500 to a suitable length; when finished using, firstly shrink the telescopic rod 500, then disassembled from the seat body 200, and then fastened from the seat body 200. At this time, the telescopic rod 500 is not rotationally connected to the seat body 200, and the telescopic rod 500 can also be switched between the stuck state and the inverted trapezoidal state.

Figure 17:
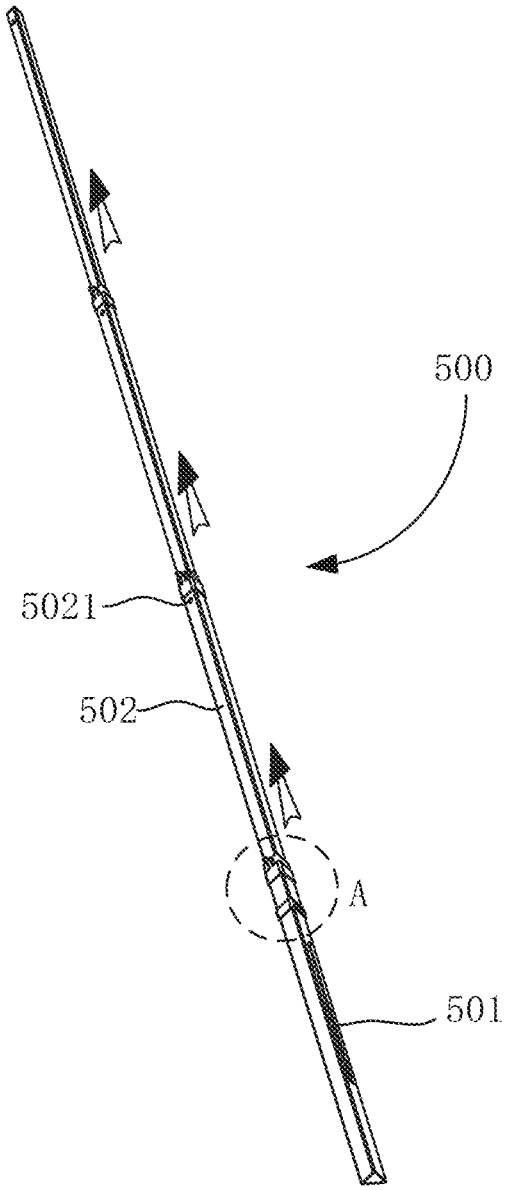
FIG. 17 is a structural schematic diagram of the telescopic rod being stretched shown in FIG. 3.
Figure 18:
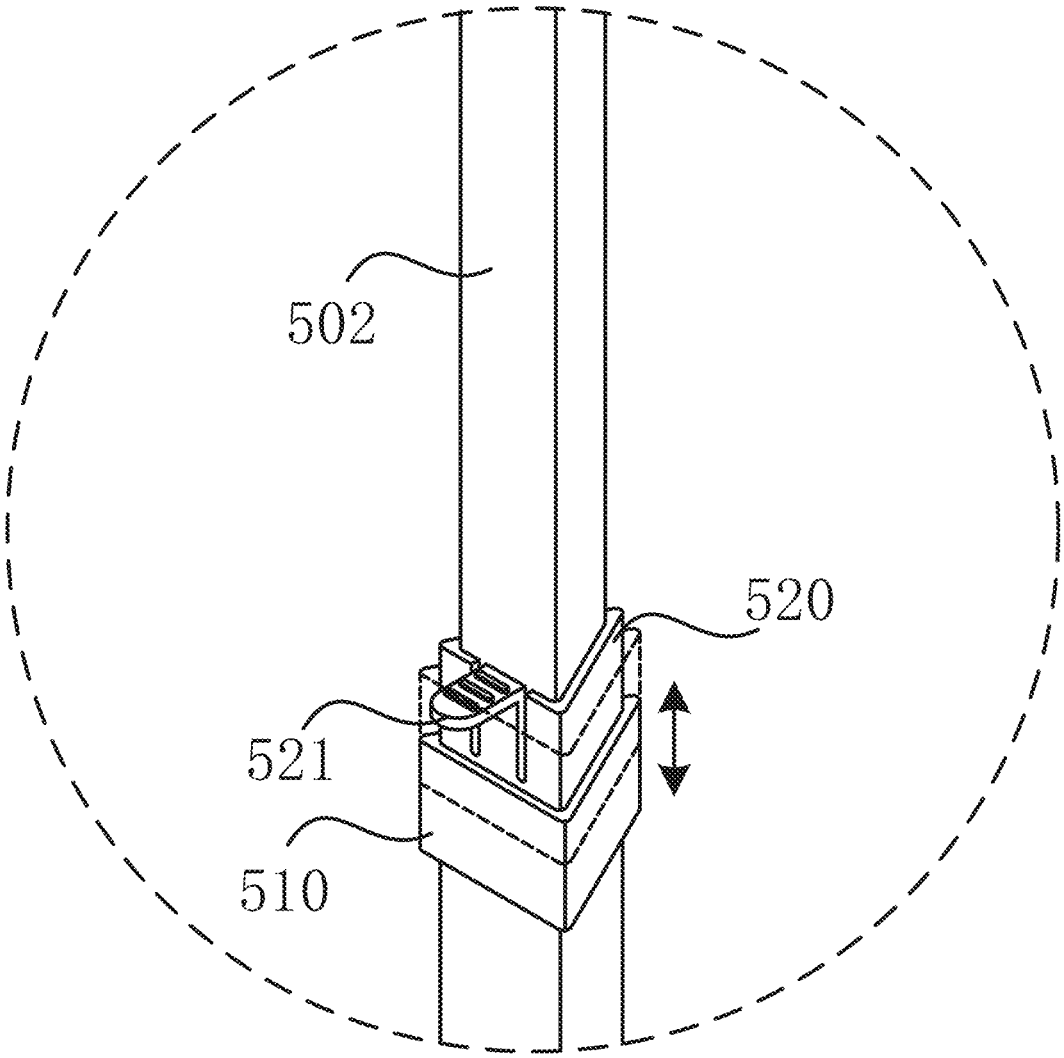
FIG. 18 is an enlarged schematic diagram of part A in FIG. 17.
Figure 19:
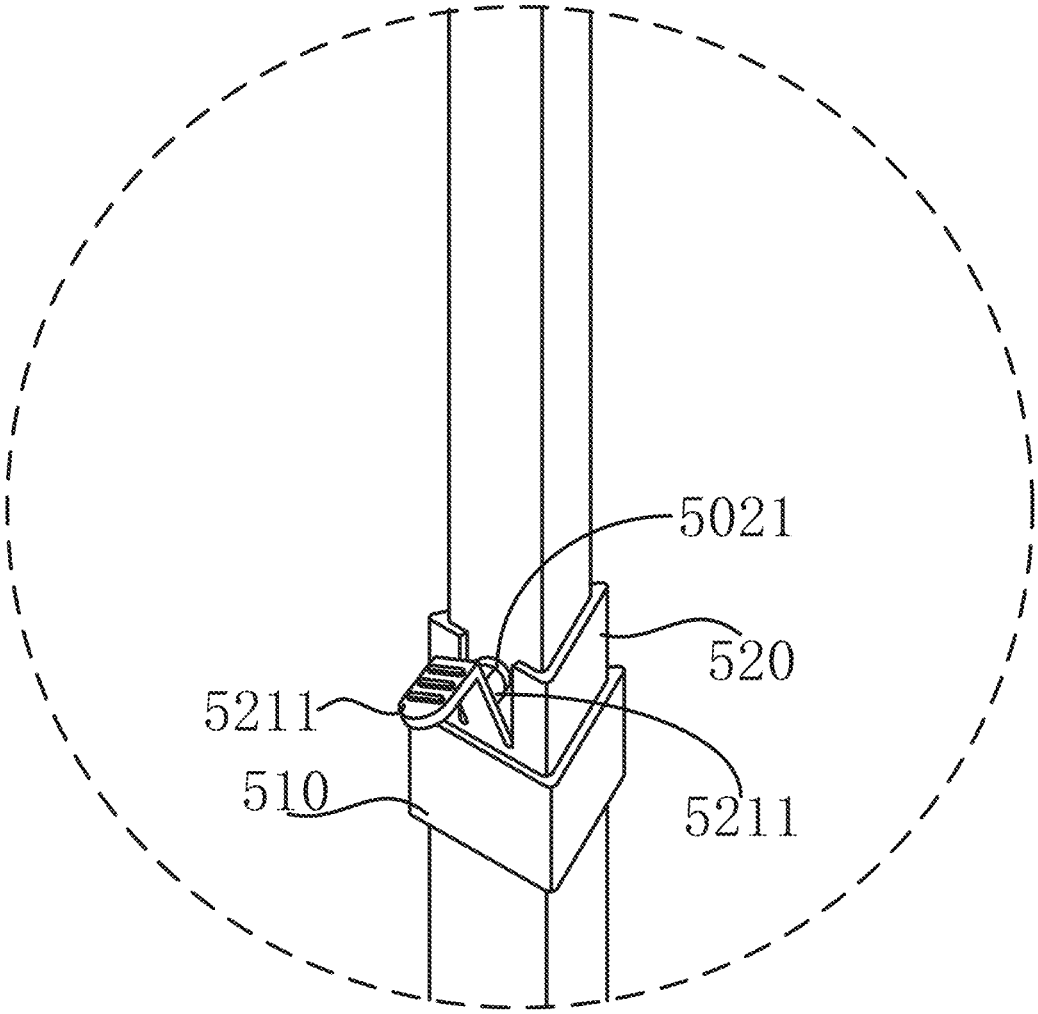
FIG. 19 is a structural schematic diagram of the telescopic rod shown in FIG. 3 in a unlocked state.
Figure 20:
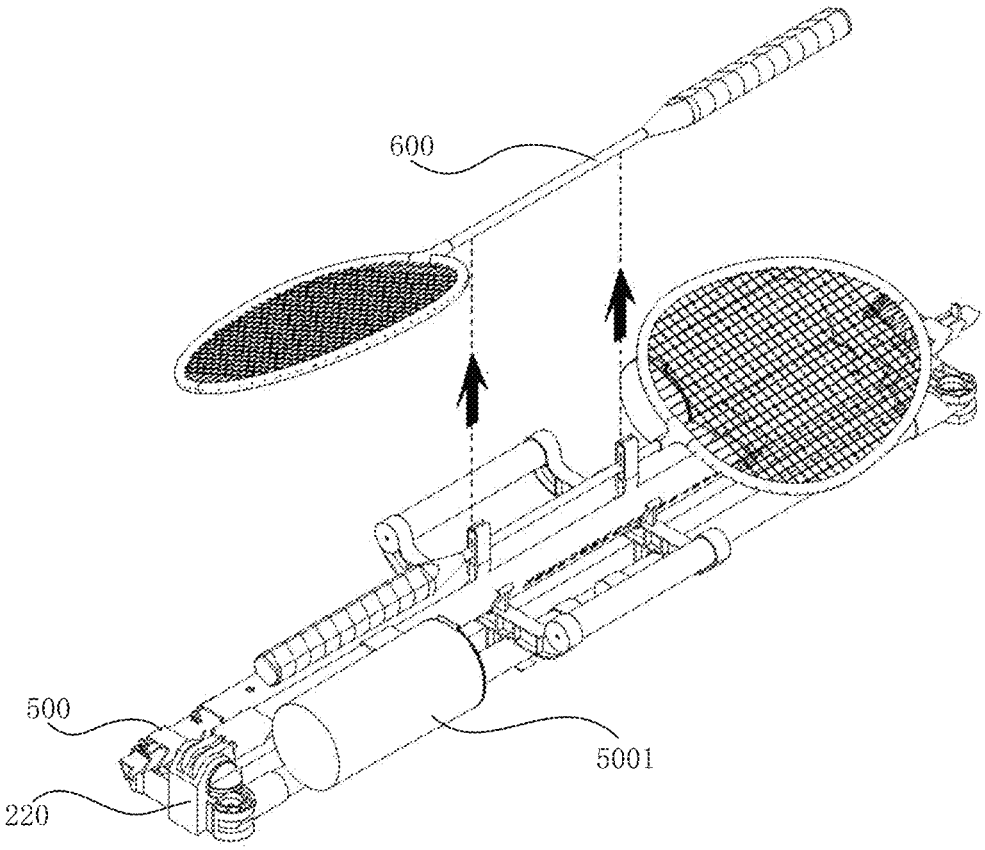
FIG. 20 is a structural schematic diagram of another embodiment of the present disclosure.
Figure 21:
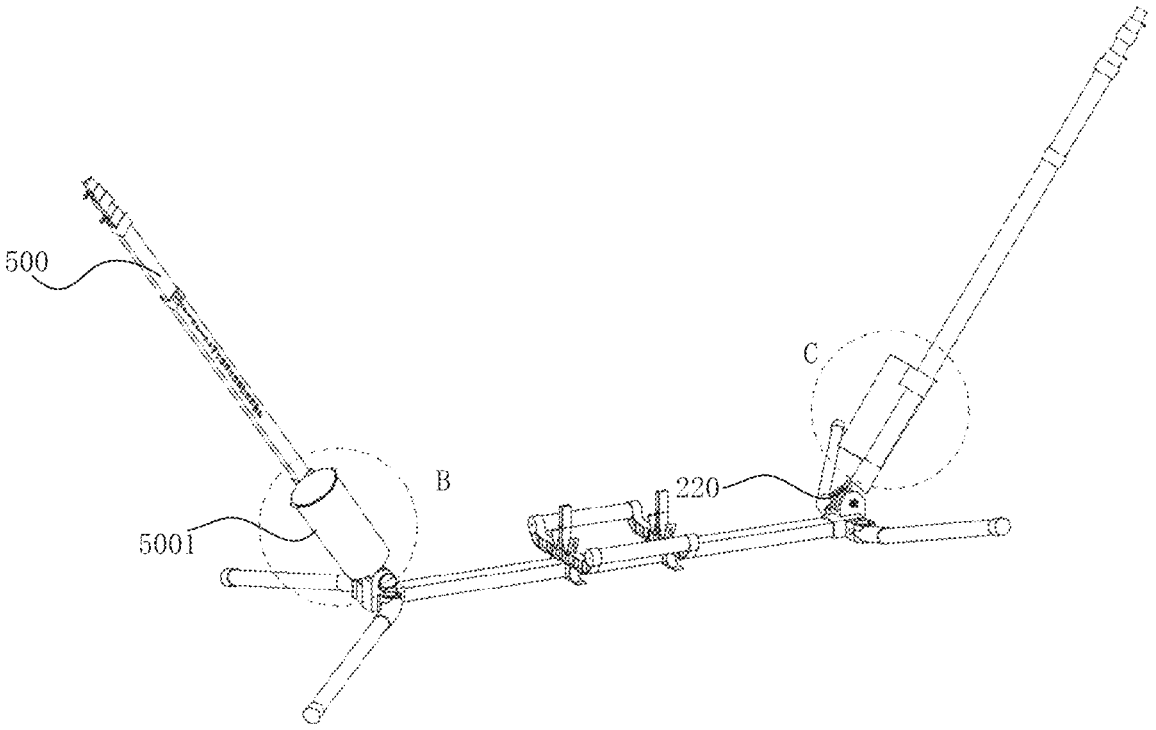
FIG. 21 is a structural schematic diagram of the badminton net rack shown in FIG. 20 in use.
Figure 22:
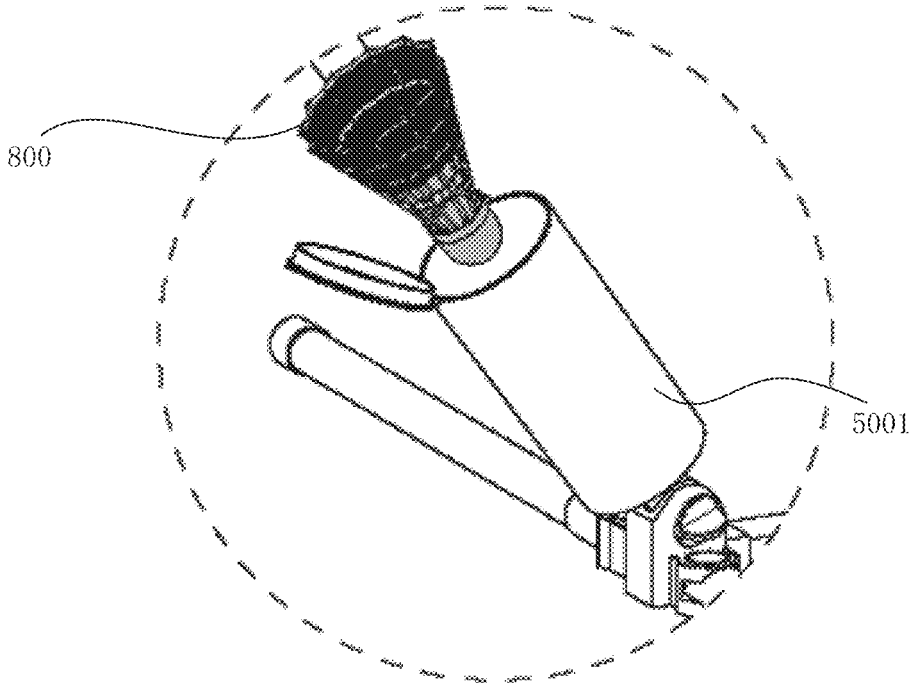
FIG. 22 is a schematic diagram of the state of placing the badminton at B shown in FIG. 21.
Figure 23:
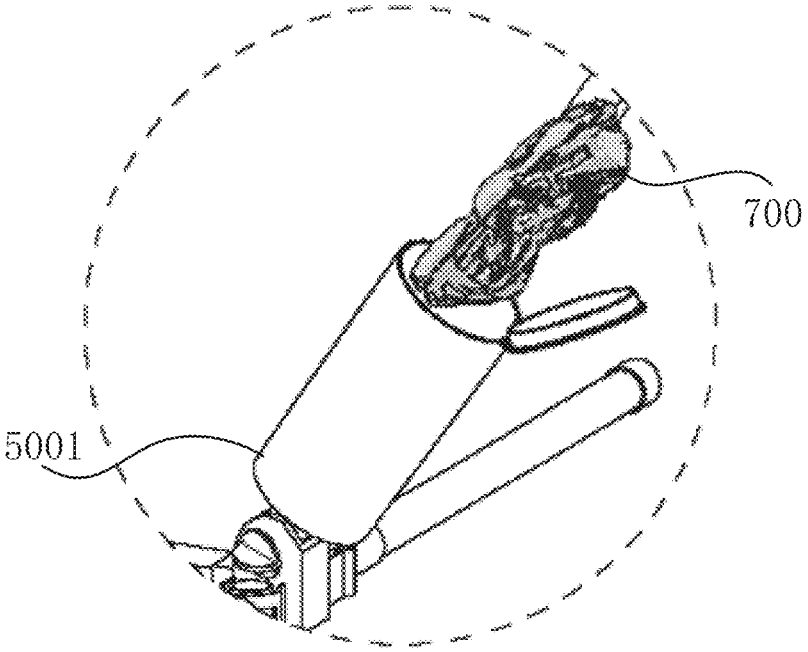
FIG. 23 is a schematic diagram of the state of placing the net at position C shown in FIG. 21.

As shown in FIGS. 17-19, The outside of the telescopic rod 500 is arranged with a stuck device 510, and a number of auxiliary rods 502 are arranged inside. One side of the auxiliary rod 502 is arranged with a fixing hole 5021, and the end of each auxiliary rod 502 is arranged with a locking rod 520. The locking rod 520 is arranged with an elastic fixed wrench 521, and the inner side of the elastic fixed wrench 521 is arranged with a block 5211, which is used to snap into the fixing hole 5021 for limit and fixation, so that the length of the telescopic rod 500 can be controlled. It can be understood that the fixed hole 5021 and the points of the scale 501 on the side wall correspond one-to-one, which can be used to display the elongation distance and facilitate the height adjustment. It should be noted that after the sub-rod 502 is extended to the preset height, the block 5211 is snapped into the fixing hole 502, push the stuck device 510 to move up, lock the elastic fixed wrench 521, and complete the fastening and fixing. The additional stuck device 510 is fixed, which can play a role of reinforcement and prevent the expansion rod 500 from shaking during use. The corresponding loosening, only needs to pull down the stuck device 510 to the bottom of the elastic fixed wrench 521, as shown in FIG. 19.

In this embodiment, the seat body 200 comprises a rotation locking mechanism 220, and the telescopic rod 500 is interference-fitted insert into the rotation locking mechanism 220, and the rotation locking mechanism 220 can drive the telescopic rod 500 to rotate, so that the telescopic rod 500 switch between the suck state and the inverted trapezoidal state. In this way, it is very convenient for the telescopic rod 500 to rotate. Specifically, in this embodiment, the seat body 200 is arranged with a button, which can control the driving mechanism to work, and the driving mechanism can control the rotation of the rotation locking mechanism 220.

In this embodiment, as shown in FIG. 3, the end of the ball net 700 is arranged with an installation pocket 722, and the end of the telescopic rod 500 away from the seat body 200 can be inserted into the installation pocket 722 to install the ball net 700. In this way, it is very convenient to assemble the ball net 700.

Figure 15:
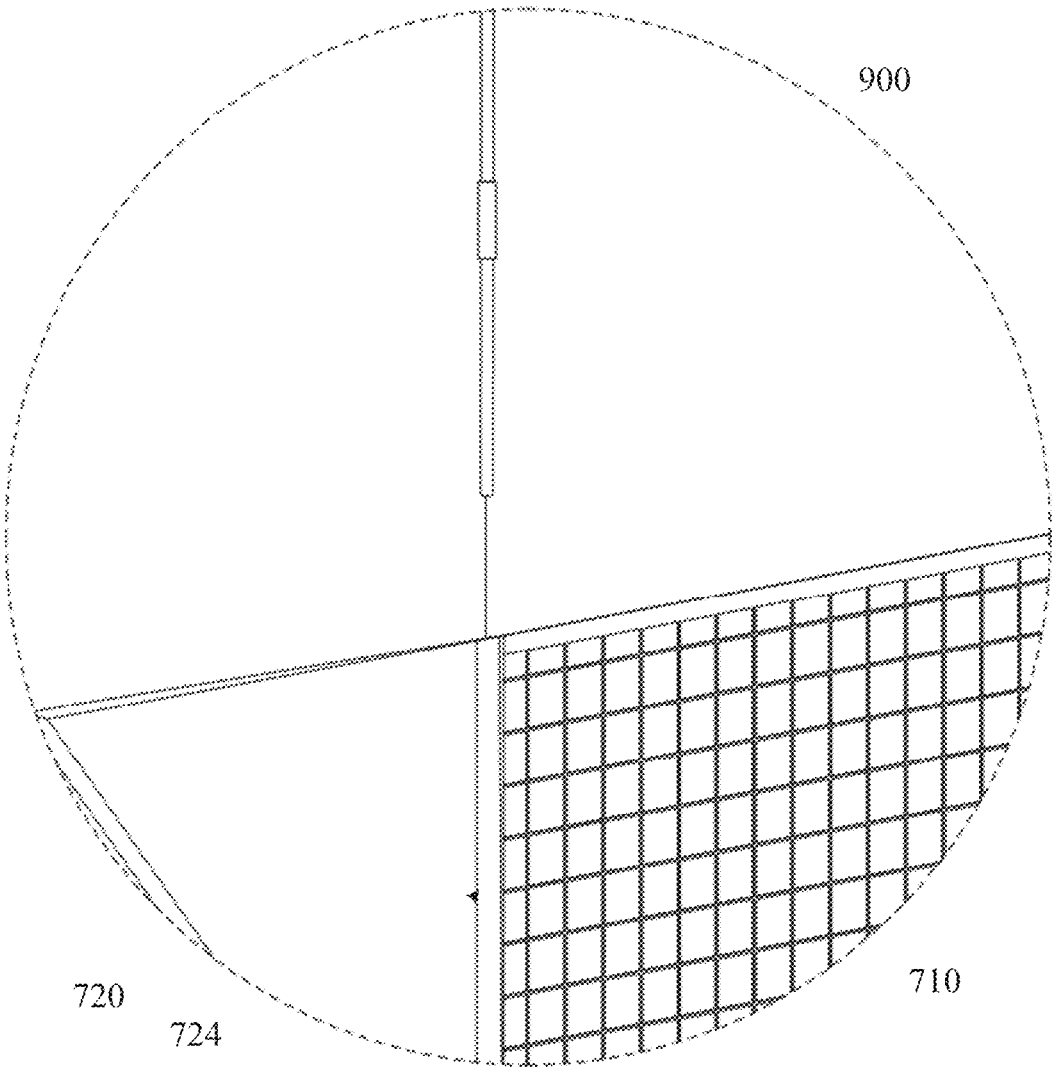
FIG. 15 is a partially enlarged view of the ball net shown in FIG. 3, wherein the reinforcing rods are to be assembled.
Figure 16:
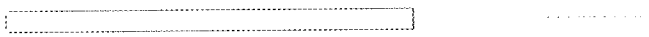
FIG. 16 is a structural schematic diagram of the reinforcement bar shown in FIG. 15.

In this embodiment, as shown in FIG. 3, FIG. 15 and FIG. 16, the badminton net rack 10 further comprises a reinforce rod 900, the ball net 700 comprises a net body 710 and a lining cloth 720 located at the end of the net body, the side of the lining cloth 720 away from the net body 710 can be connected to the telescopic rod 500, and the junction of the lining cloth 720 and the net body 710 is arranged with a reinforce bag 724, and the reinforce rod 900 can be plugged into the reinforce bag 724. The reinforce rod 900 can reinforce the ball net 700. Specifically, in this embodiment, the reinforce rod 900 is foldable. In this way, the reinforce rod 900 can be accommodated in the accommodation space 200*a* of the base body 200 as a part, so that the badminton rack 10 is more portable.

In another embodiment, as shown in FIGS. 20-23, a storage barrel 5001 is arranged at the place where the end of the telescopic rod 500 is connected to the locking mechanism 220, and there are at least two storage barrels 5001, which are respectively fixed on the end of the telescopic rod 500, the storage bucket 5001 can respectively place at least one of the net 700 or badminton 800 or parts.

The above description is only a description of the preferred embodiments of the present disclosure, and does not limit the scope of the present disclosure. Any changes and modifications made by those of ordinary skill in the field of the present disclosure based on the above disclosures shall fall within the protection scope of the claims.

What is claimed is:

1. A badminton net rack, comprising:

a base, and the base has an grounding side and a mounting side opposite to each other, the base comprises two seat bodies, a support rod connecting the two seat bodies, and a connector spanning the support rod, the connector comprises a first stuck part and a second stuck part, an opening of the first stuck part faces the grounding side, an opening of the second stuck part faces the mounting side, and the first stuck part is used for stuck badminton rackets;

two telescopic rods, configured to be switched between an inverted trapezoidal state and a stuck state, in the inverted trapezoidal state, the two telescopic rods are respectively connected to the two seat bodies to form an inverted trapezoidal structure for installing a ball net, in the stuck state, the two telescopic rods are respectively stuck to the second stuck part of the connector; and the ball net;

wherein outsides of the two telescopic rods are arranged with a stuck device, and insides of the two telescopic rods are arranged with several auxiliary rods, ends of the auxiliary rods are arranged with a lock rod, and the lock rod is arranged with an elastic fixed wrench;

wherein there are three support rods, which are two first support rods and one second support rod, the two first support rods are closer to the grounding side than the second support rod, and the two first support rods are spaced at equal heights, the second support rod is closer to the mounting side than the two first support rods, and the second support rod is located between the two first support rods;

the connector further comprises a third stuck part positioned at each end and a fourth stuck part at a middle, openings of the two third stuck parts are positioned at each end which are opposite from one another, and they are respectively stuck to the two first support rods, an opening of the fourth stuck part faces the mounting side and is stuck to the second support rod.

2. The badminton net rack according to claim 1, wherein each of the two seat bodies has an insertion port, and an end of the support rods is interference-fitted with the insertion port of the seat bodies.

3. The badminton net rack according to claim 1, wherein a distance between the two seat bodies is greater than lengths of the badminton rackets.

4. The badminton net rack according to claim 1, wherein there are multiple connectors, and the multiple connectors are arranged at intervals along a length direction of the support rods.

5. The badminton net rack according to claim 1, wherein the connector comprises a plurality of first stuck parts, and the plurality of first stuck parts are arranged at intervals along a length direction of the connector, and a spacing distance between two adjacent first stuck parts is configured to realize: when the badminton rackets are stuck one-to-one with the first stuck parts, two badminton rackets on two adjacent first stuck parts are configured to be partially stacked.

6. The badminton net rack according to claim 5, wherein a distance between two adjacent first stuck parts is configured to realize: when the badminton rackets are stuck one-to-one with the first stuck parts, an overlapping portion of a mesh portion of the two badminton rackets on the two adjacent first stuck parts is greater than two-thirds of the mesh portion.

7. The badminton net rack according to claim 5, wherein the first stuck parts are used for stuck with thin shaft parts of the badminton rackets, and depths of the first stuck parts are greater than a sum of diameters of the thin shaft parts of the badminton rackets.

8. The badminton net rack according to claim 1, wherein each of the two seat bodies comprises an accommodating space, which is configured to accommodate at least one of the ball net or badminton rackets or first and second stuck parts.

9. The badminton net rack according to claim 1, wherein the two seat bodies comprise a rotation locking mechanism, and the two telescopic rods are interference-fitted insert into the rotation locking mechanism, and the rotation locking mechanism is configured to drive the two telescopic rods to rotate, so that the two telescopic rods switch between the stuck state and the inverted trapezoidal state.

10. The badminton net rack according to claim 1, wherein an end of the ball net is arranged with an installation pocket, and ends of the two telescopic rods away from the two seat bodies are configured to be inserted into the installation pocket to install the ball net.

11. The badminton net rack according to claim 1, wherein the badminton net rack further comprises a reinforce rod, the ball net comprises a net body and a lining cloth located at an end of the net body, one side of the lining cloth away from the net body is configured to be connected to the two telescopic rods, and a junction of the lining cloth and the net body is arranged with a reinforce bag, and the reinforce rod is configured to be plugged into the reinforce bag.

* * * * *